US009679443B2

(12) United States Patent
Kaiblinger et al.

(10) Patent No.: US 9,679,443 B2
(45) **Date of Patent: *Jun. 13, 2017**

(54) GAMBLING AND/OR GAMING APPARATUS

(71) Applicant: NOVOMATIC AG, Gumpoldskirchen (AT)

(72) Inventors: Harald Kaiblinger, Pfaffstätten (AT); Florian Schrötter, Traiskirchen (AT)

(73) Assignee: NOVOMATIC AG, Gumpoldskirchen (AT)

( * ) Notice: Subject to any disclaimer, the term of this patent is extended or adjusted under 35 U.S.C. 154(b) by 0 days.

This patent is subject to a terminal disclaimer.

(21) Appl. No.: 15/276,534

(22) Filed: Sep. 26, 2016

(65) Prior Publication Data

US 2017/0032624 A1 Feb. 2, 2017

Related U.S. Application Data

(63) Continuation of application No. 14/070,327, filed on Nov. 1, 2013, now Pat. No. 9,472,053, which is a (Continued)

(51) Int. Cl.
*G07F 17/32* (2006.01)

(52) U.S. Cl.
CPC ..... *G07F 17/3295* (2013.01); *G07F 17/3206* (2013.01); *G07F 17/3209* (2013.01); *G07F 17/3211* (2013.01); *G07F 17/3262* (2013.01)

(58) Field of Classification Search
CPC ..... G07F 17/3295; G07F 17/3206; G07F 17/3209; G07F 17/3211; G07F 17/3262
(Continued)

(56) References Cited

U.S. PATENT DOCUMENTS 5,101,354 A 3/1992 Mowers et al.
5,255,185 A 10/1993 Mowers et al.
(Continued)

FOREIGN PATENT DOCUMENTS

DE 69622153 8/2002
DE 10309676 9/2004
(Continued)

*Primary Examiner* — David L Lewis
*Assistant Examiner* — Shauna-Kay Hall
(74) *Attorney, Agent, or Firm* — Levine Bagade Han LLP

(57) ABSTRACT

The present invention refers to a gambling and/or gaming apparatus comprising an input apparatus for inputting of a stake or and/or playing-tip information in the form of a number and/or number combination and/or a number matrix, an outcome ascertainment apparatus for ascertaining a winning number and/or a winning number combination and/or a winning number matrix, an indicator apparatus for indicating the ascertained winning number and/or the ascertained winning number combination and/or the ascertained winning number matrix, and a win ascertainment apparatus for ascertaining a gambling and/or gaming win from a comparison of the ascertained winning number and/or the ascertained winning number combination and/or the ascertained winning number matrix with the input stake and/or playing-tip information. According to the invention, the outcome ascertainment apparatus of the gambling and/or gaming apparatus, which is used to ascertain the winning number, winning number combination and/or the ascertained winning number matrix, comprises a monitoring apparatus for monitoring at least one skill/skilled sport installation on which a game of skill/skilled sport which provides at least one game outcome can be executed by at least one participant, wherein the monitoring apparatus comprises game outcome determination means for determining the game outcome, wherein the monitoring apparatus comprises a game outcome determination means for
(Continued)

determining the game outcome, and a determination device for determining the winning number and/or winning number combination and/or a winning number matrix from the determined game outcome.

22 Claims, 6 Drawing Sheets

Related U.S. Application Data continuation of application No. PCT/EP2011/002202, filed on May 3, 2011.

(58) Field of Classification Search
USPC ..... 463/7
See application file for complete search history.

(56) References Cited

U.S. PATENT DOCUMENTS

| | | | | |
|---|---|---|---|---|
| 5,577,971 | A | 11/1996 | File | |
| 5,626,523 | A | 5/1997 | Mowers et al. | |
| 5,899,815 | A | 5/1999 | Helou et al. | |
| 6,048,272 | A * | 4/2000 | Tsujita | A63D 5/04 463/25 |
| 6,254,600 | B1 | 7/2001 | Willink et al. | |
| 6,623,369 | B1 | 9/2003 | Shea | |
| 2005/0245305 | A1 | 11/2005 | Asher et al. | |
| 2005/0288115 | A1 * | 12/2005 | Popielarz | A63D 1/06 473/101 |
| 2007/0275787 | A1 | 11/2007 | Bouchard et al. | |
| 2011/0034261 | A1 * | 2/2011 | Kawaguchi | A63D 5/04 473/54 |
| 2011/0124424 | A1 | 5/2011 | Mruk | |
| 2011/0301726 | A1 | 12/2011 | Colquitt, Sr. | |
| 2013/0157736 | A1 | 6/2013 | Smith et al. | |
| 2014/0135085 | A1 | 5/2014 | Kaiblinger et al. | |

FOREIGN PATENT DOCUMENTS

| | | |
|---|---|---|
| EP | 1002558 | 5/2000 |
| WO | WO 2007/067790 | 6/2007 |
| WO | WO 2012/149943 | 11/2012 |

* cited by examiner

GAMBLING AND/OR GAMING APPARATUS

CROSS-REFERENCE TO RELATED APPLICATIONS

The present application is a continuation of U.S. patent application Ser. No. 14/070,327, filed on Nov. 1, 2013, which is a continuation of PCT Application No. PCT/EP2011/002202, filed May 3, 2011, which are incorporated by reference herein in their entireties.

BACKGROUND

1. Technical Field

The present invention refers to a gambling and/or gaming apparatus comprising, an input apparatus for the input of a piece of stake and/or playing-tip information in form of a number and/or a number combination and/or a number matrix, an outcome ascertainment apparatus for the ascertainment of a winning number and/or a winning number combination and/or a winning number matrix, an indication apparatus for the indication of the ascertained winning number and/or the ascertained winning number combination and/or the ascertained winning number matrix, and a win ascertainment apparatus for the ascertainment of gambling or gaming winnings from a comparison of the ascertained winning, number combination and/or the ascertained winning number combination and/or the ascertained winning number matrix with the input piece of stake and/or playing-tip information.

2. Description of the Related Art

Gambling and/or gaming machines often operate with winning numbers or winning number combinations, which are "gambled on" with a game stake so that then in dependence thereof, whether the numbers gambled on correspond with the played numbers, winnings are paid out or not. Such stakes or winnings can be represented in the form of money, but also in the form of money-like equivalents such as tokens, or also in the form of virtual stakes, for example in the form of game credits or virtual "player life". The playing or determination of the respective winning numbers can hereby occur in many different forms, for example in the form of lottery games or roulette games, wherein determined numbers, number combinations or number fields, i.e. numbers arranged on a number field in a determined arrangement, can be gambled on and played. Alternatively or additionally bingo games or also reel games can be foreseen wherein a certain number sequence or number combinations must occur in a predetermined payline, for example in a number field or on a reel name background, in order to win.

The playing of the winning numbers or winning number combination occurs thereby classically by a random number generator, for example in the form of an electronic component of the automatic gaming machine control, which without the possibility of influence by the operator of the automatic gaining or gambling machine specifies the respective winning number for a round of game.

However, the generation of the winning numbers by such an electronic random number generator makes the corresponding automatic gaming or gambling machine appear non-transparent and therefore with a limited entertainment value as the events to be played or to be gambled on may appear too virtual or artificial for the automatic machine user and the win determination may not appear comprehensible. Therefore it has been contemplated recently to make live events such as, for example, sports competition subject of the events to be gambled or gamed on by the automatic machines. Traditionally sport competitions such as horse racing or football games can hereby be gambled on on-site. It was hereby also recommended to be able to place pieces of stakes via online systems and to transmit the results in turn online on a gambling terminal in order to display these there. Such online gambling systems, however, are subject to an increased danger of manipulation or security requirements in order to accommodate for the physical separation of gambling or gaming terminal on the one hand and the event location of the sport competition or game on the other hand. It must not only be guaranteed that the sport competition to be gambled on or the game to be gambled on itself is executed in a regular manner, but also above all that the temporal interlocking of event and transmission of the event to be gambled on and the data input for the piece of stake is organized in such a manner that a subsequent gambling with knowledge of the outcome is prevented, wherefore it is also necessary to eliminate subsequent data manipulation.

DE 10309676 A1 describes a system for the recording, transmission, and indication of data of a bowling centre that records images of the course of the game with electronic cameras and provides these for internet access. Furthermore game outcome data entered at the bowling centre are also provided for internet access so that the courses of the game and the game outcome generated at one gaming location are indicated and can be followed at a different gaming location. With opposite alignment of the system gaming or competition participants, who are at different gaming locations, can hereby play against each other. Furthermore EP 10 02 558 A2 describes an apparatus for the positioning of skittles on a skittle alley, which optically scans the skittle field via an image recording apparatus, detects fallen skittles or skittles remaining standing through image data, which are then compared with preset image data whereupon a skittle setter apparatus is selected by a control apparatus in order to re-erect the fallen skittles.

Furthermore DE 696 22 153 T2 describes an electronically controlled score of a skittle alley, which is connected with a monitoring apparatus for the scan of overturned skittles on a skittle alley and selects at the end of the skittle alley controls displays in order to indicate the game outcome, i.e. the number of overturned skittles.

SUMMARY OF THE INVENTION

The addressed problem of the present invention is to create an improved gambling or gaming apparatus of the above-mentioned kind, which prevents the disadvantages of the state-of-art technology and to develop the latter further in a favourable manner. In particular an interesting win ascertainment for automatic gaming and gambling machines is to be created, which impede the manipulation of the game operation and deceit and improves the safety of the control, monitoring, and analysis of the game operation.

According to invention the mentioned problem is solved by a gambling and/or gaming apparatus in accordance with claim 1. Preferred embodiments of the invention are the subject of the dependent claims.

It is thus recommended that for the ascertainment of a winning number or a winning number combination or winning number matrix to access a skill/skilled sport or competition installation whose outcome is a discrete numerical value and to transmit it to the control of the gambling and/or gaming apparatus. The number or number combination ascertained from the game outcome can be used in a gambling and/or gaming apparatus as winning number or winning number combination instead of a random number or random number combination generated by an electronic random number generator. This is insofar advantageous as for a user of the automatic gaming machine by indicating the course of the game of skill/skilled sport the creation of the random number is transparent, i.e. it is a comprehensible or visible event, and thereby the trust of in the system is strengthened. At the same time the system offers in sufficiently short time intervals reliable random numbers. According to invention the outcome ascertainment apparatus of the gambling and/or gaming apparatus by means of which the winning number, winning number combination and/or winning number matrix is ascertained, comprises a monitoring apparatus for monitoring at least one skill/skilled sport installation, on which a game of skill/skilled sport can be executed by at least one participant, which delivers at least one game outcome, wherein the monitoring apparatus comprises game outcome ascertainment means for the ascertainment of the game outcome, and a determination apparatus for the determination of the winning number and/or winning number combination and/or winning number matrix from one or multiple determined game outcomes. The winning number, winning number combination or winning number matrix can directly correspond with the respective numerical value of one or multiple game outcome(s), but can preferably also be derived in consideration of a predetermined calculation or generation rule.

A game of skill/skilled sport within the meaning of the present registration can hereby comprise different forms of games or competition or generally live events, which can be held for fun without profit opportunity by amateurs or professionals or in the form of tournaments with competitive character and without profit opportunity. In a further advantageous embodiment of the invention the monitoring apparatus is hereby allocated to a skittle or bowling alley, on which in familiar fashion by the rolling along of a ball on an alley the skittles or pins standing at the end of the alley can be overturned. The discrete numerical values serving as outcome are hereby the respective number of skittles or pins overturned by one attempt but also by multiple attempts. Alternatively or additionally the monitoring apparatus can also monitor a shooting gallery installation, be it a bow and arrow installation, an arbalest installation, a gun or riffle installation, or also a dart installation. Hereby the numerical values used as outcome are the respectively hit target rings or target panels.

Depending on what type of automatic gambling and/or gaming machine the game outcome in the form of a discrete numerical value is used for, the determination of the number sought or the number combination sought can occur in different ways. If, for example, in the manner of a lottery or a roulette game a single winning number is sought, the above-mentioned determination apparatus can comprise a determination apparatus for the determination of a number out of multiple numerical values in accordance with a specifiable calculation specification By using multiple numerical values for the determination of the number the predictability and the danger of manipulation can be reduced as the contingency component of the game of skill/skilled sport has a greater effect. For example, the game outcomes for skittle or bowling events of multiple players on different alleys can be added, or the outcome of one player in various attempts can be added, for example in such a manner that the number to be created or the winning number is added as a sum of the skittles overturned in one round by four skittle players competing with each other.

Alternatively or additionally, if not an individual number but a number sequence or a number matrix is to be determined, the mentioned determination apparatus can then comprise an allocation apparatus for the allocation of individual numerical values or the numbers calculated thereof to one respective number slot in the number sequence or number matrix in accordance with a specifiable attribution specification. Advantageously with the monitoring of the skittle or bowling alley the respective skittles overturned in one round by various participants can form the numerical value of one line, while skittles overturned in various rounds can form the further lines of the number matrix.

In a further embodiment of the invention the gambling and/or gaming terminal of the gambling and/or gaming installation has a betting field that indicates possible winning numbers and/or winning number combinations and in which the desired winning numbers and/or winning number combinations and/or also the desired winning field areas can be entered or can be gambled on by the respective user. The mentioned betting field can hereby be formed in principle mechanically in form of a betting table, but in particular also virtually in form of a screen indication, for example on a touch screen, in order to facilitate a simple gambling or input of the respective piece of stake. The mentioned betting field can hereby be configured in different manners, wherein the betting field must in particular not correspond with the target of the skill/skilled sport, i.e. in the event of a skittle alley with the positioning of the skittles. Advantageously the betting field can contain a number matrix or an assembly of numbers selected in a different alignment, which form the possible winning numbers, for example in the manner of a roulette betting field.

In order to facilitate a simple operation and handling of the gambling and/or gaming terminal indicator means are foreseen in the betting field in the further embodiment of the invention, which are controllable by the win ascertainment means of the gaming and/or gambling apparatus in dependence of the game outcome of the skill/skilled sport event and are foreseen for the indication of the ascertained winning numbers. In particular the indicator means can be allocated to the winning numbers foreseen in the betting field, for example in such a manner that a winning betting field is illuminated or spotlighted in a particular colour. Alternatively or additionally indicator means can also be allocated to the mentioned betting field which mark the winning numbers, for example backlighting or spotlighting in a particular colour. For the win indication the winning numbers gambled on can be, for example, emphasized then by the above-mentioned indicator means in a particular way, for example by a continuous or blinking backlight or illumination. Alternatively or additionally also non-winning, but gambled on numbers can be emphasized in a particular manner, for example by an illumination in a colour indicating loss.

In a further advantageous embodiment of the invention not only the outcome but also the course of the game outcome of the skill/skilled sport is indicated on the gambling and/or gaming terminal. Advantageously therefor a screen is foreseen on the gambling and/or gaming terminal, which indicates the images recorded by the cameras on the skill/skilled sport installation. Hereby a user of the gambling and/or gaming terminal can follow the developments of events of the competition after the placement in order to be then informed about the events occurred in the mentioned manner.

The monitoring apparatus can therefor advantageously monitor multiple alleys of the skill/skilled sport installation via the corresponding monitoring means in order to monitor the game outcomes of different participants on multiple alleys of the installation. The determination apparatus can then determine the sought number or number combination from the game outcomes of the different alleys. The monitoring therefor can in principle occur in different ways and manners. For example, the monitoring means can comprise cameras, which observe the skittle fields and identify the number of skittles or pins overturned by an image evaluation apparatus, preferably through a before and after comparison. Alternatively or additionally the outcome determination means for the determination of the game outcome can also be integrated in the setter apparatus for the automatic setting of the skittles or pins, for example in such a manner that the outcome determination means identify the displacement of the threads on which the skittles are hanging when overturning the respective skittles, or with a threadless setter apparatus identify the skittles remaining standing and/or the overturned skittles by means of the grippers, for example by the gripper head with the gripper means initially reverting to the setter position and taking hold wherein the remaining standing skittles can be identified.

With game or sport locations with various alleys the allocation of the individual alleys to the participants is advantageously determined or allotted by a random number generator, i.e. combination pairs of the respective participants and the respective alley are ascertained. Thereby an improved distribution of contingency can be achieved as existing alley particularities such as, for example, different light incidence, different alley inclination or different evenness of the game alleys are integrated in the determination of the numbers or number combinations. Advantageously the participants are hereby determined out of a participant pool by a random number generator and allocated to the respective alleys, or conversely the alleys are allocated to the selected participants. Advantageously the number of participants can be greater than the number of the alleys to be played. Alternatively or additionally also the allocation of the game equipment, in particular the throw ball or bowling ball to the participants, can be determined.

In a further advantageous embodiment of the invention also multiple skill/skilled sport locations, for example in the form of bowling or skittle alleys which are foreseen at different places or also in different countries, can be monitored by means of multiple monitoring apparatus of the mentioned kind in order to be able to select by means of a suitable selection apparatus a respective skill/skilled sport installation, whose game outcomes are then used for the ascertainment of winning numbers or winning number combinations or winning number matrix. The selection can hereby occur in principle in different ways and manners. For example, the selection apparatus could comprise an electronic random number generator by means of which the skill/skilled sport installation used for the winning number ascertainment is selected in a random manner. Alternatively or additionally the gambling and/or gaining terminal can also comprise input means by means of which the skill/skilled sport installation used for the winning number ascertainment can be selected by the user of the gambling and/or gaming terminal. Hereby the respective user of the gambling and/or gaming apparatus is given greater transparency and the feeling of absolute security against manipulation as the ascertainment of the winning number or the winning number combination depends on the selection of the skill/Skilled sport installation by the user. Notwithstanding, through the mentioned selection apparatus the degree of contingency of the winning number ascertainment is further increased as the influences of different skill/skilled sport installations and the execution of skill/skilled games thereon, which can be different, for example with a first installation bowling and with a second installation dart, are integrated in the winning number determination.

In a further advantageous embodiment of the invention the selection apparatus can hereby feature allocation means which make it possible to select for different number slots of a number combination or number matrix different skill/skilled sport installations in such a manner that, for example, for the first column of a number matrix a first skill/skilled sport installation is selected and the hence ascertained game outcomes are used, for a second column of the winning number matrix a second skill/skilled sport installation is used and the there ascertained game outcomes are used, and for a third column of the winning number matrix a third skill/skilled sport installation—or, if applicable, also the first skill/skilled sport installation is selected and the there ascertained game outcomes are used.

The mentioned allocation of the different, selected skill/skilled sport installations to the individual number slots can hereby occur in principle in different manners. For example, the mentioned allocation means can comprise an electronic random number generator in order to conduct the allocation in a random manner. But alternatively or additionally input means can be foreseen at the gambling or gaming terminal which permit the mentioned allocation to be performed by the user of the gambling and/or gaming apparatus.

In order to prevent manipulation regarding the game control it is recommended to divide the data used for the control or monitoring of the game operation in multiple locations and file selectively in different data memories, so that only a central control or monitoring computer, which, if applicable, can consists of multiple, separate computer units, has access to all necessary data. In particular the participant-specific and the sport equipment-specific data are divided in order to be able to monitor and control centrally the allocation of participant and game equipment or alley to each other. Advantageously every game participant is provided with a participant memory separate from the game equipment memory, in which participant data, in particular identification data such as participant identification are saved, which are readout by a reception/reading apparatus and are filed in the database, in which also the game equipment data is saved, and/or are filed in a further database, and wherein the game equipment data saved in the database or the databases and the participant data are allocated to each other with the aid of allocation means and wherein a renewed readout of the game equipment data and participant data is performed and the allocation of the renewed readout game equipment data with the renewed readout participant data is compared with the previous allocation assigned by the allocation means. With the division of the data to be saved in multiple memory locations and the usage of separate saving means on the game equipment in the event of skittle alleys on the balls as well as on the participants the manipulation possibilities are reduced substantially, in particular also because the connection of the relevant data, on the one hand relating to the game equipment and/or the game alleys and on the other hand relating to the participants, occurs at a central computer and the database allocated thereto at a location not only separate of the participants but also of the game equipment. In addition, the control of the allocation of participants and game equipments thereby becomes variable and can also be specified by the computer system only shortly prior to the commencement of the game, wherein manipulation of the game equipment and the game equipment memories attached thereto is made difficult. In particular the allocation generated by the allocation means can also be used to specify a starting position. The renewed readout of the game equipment data and participant data and the monitoring of the allocation of the renewed readout data with the previous allocation assigned by the allocation means permits the assertion whether the generated game equipment/participant allocation was adhered to.

The readout of the game equipment data saved in the game equipment memories and the participant data saved in the participant memories can hereby occur actively or passively, depending on which type of memory elements are used on the game equipment and the participants. For example, the memories foreseen for the game equipment and/or the participants can be provided with actively sending sender units so that in this case a passive reception apparatus for the readout or reception of data is sufficient. Alternatively or additionally also only passive and on demand sending sender units can be foreseen on the game equipment and/or the participants so that in this case advantageously active reading apparatus for readout of the corresponding data are used which query with corresponding signals the memory means on the game equipment and/or participants actively.

In particular RFID elements can be used as game equipment memory and/or participant memory, wherein advantageously in this case the mentioned reception/reading apparatus are designed as RFID reading apparatus. The use of such RFID elements and corresponding RFID reading apparatus has numerous advantages, amongst others, there is not "sight contact" necessary between sender and receiver, furthermore a high resolution of the position location is possible, i.e. the readout of data can occur in a simple manner only if the RFID tag is located at the right, thereof foreseen place and furthermore it is possible to work with low electricity consumption values.

Alternatively or additionally to such RFID elements or RFID reading apparatus also barcode elements can be used as participant memory or game equipment memory, whose barcode contains the respective information, in particular game equipment identification or participant identification. As reading apparatus advantageously barcode readers are then used with the aid of which barcode elements can be read.

With the above-mentioned usage of separate memory elements on the game equipment and the participants the allocation of participants and game equipment to each other can be specified at a short notice and reversed in order to eliminate the interest of manipulation on specific game equipment. The computer system for the monitoring or control of the game operation, which has access to at least one database in which the game equipment data and the participant data are filed in separate memory locations, allocates a specific participant to a specific game equipment and shows this on an indicator panel or another suitable indicator means shortly prior to the commencement of a game. In particular the computer can therefor feature an electronic random number generator or be connected to such one, so that the random number generator performs the allocation of game equipment data to the participant data automatically so that a determined game equipment is allocated to a determined participant in a random manner.

In a further embodiment of the invention a monitoring apparatus is foreseen which monitors whether the allocation specified by the allocation means of participant and game equipment is also adhered to. In dependence of a monitoring signal released by the monitoring apparatus the event can be, for example, cleared or stopped.

In a further advantageous embodiment of the invention a monitoring apparatus is additionally or alternatively foreseen, which monitors whether a respective game equipment is used on the "right" alley allocated by the computer. Advantageously with the existence of multiple alleys hereto every alley can be allocated to a reception/reading apparatus for the readout of the game equipment data from a game equipment memory, wherein the mentioned reception/reading apparatus is advantageously designed in such a manner that from the respective apparatus only the game equipment data of the respective game equipment is readout which is located on the respective alley. Advantageously corresponding RFID reading apparatus can be integrated in the skittle alleys, for example positioned underneath the alley surface.

Advantageously an allocation of the game equipment data and/or participant data saved in the database to the alleys also occurs automatically by the means of a random number generator, wherein the computer-assisted allocation of the alleys to the game equipment data and/or participant data is indicated prior to the commencement of a game on the above-mentioned indicator means.

Advantageously the mentioned monitoring apparatus for the observance of alleys can comprise a release apparatus, which only releases the respective alley, if the game equipment data and/or participant data readout by a reading apparatus situated on the alley corresponds with the specified allocation of the alleys to the game equipment and/or participants. The mentioned release apparatus can in turn hereby be foreseen in the central computer for the control of the game operation in order to block the operation of the alley, if the game equipment and/or participant stand(s) on the wrong alley.

In a further embodiment of the invention advantageously also a monitoring of the skill/skilled sport installation is variably controlled by suitable monitoring means, for example in form of one camera or multiple cameras in dependence of game equipment data readout from the game equipment memories and/or in dependence of the participant data readout from the participant memories and/or the effected allocation of this game equipment and participant data. For example, the control is such that the computer activates and/or deploys in each case the respective camera which has the currently active participant of a game within the area of coverage. Alternatively or additionally in dependence of the game equipment data readout from the game equipment memories the switch between different camera positions can be set, wherein in particular a setup of the switch means foreseen on the skill/skilled sport installation for switching the camera positions in dependence of the game equipment data can be set. For example, switch means can be foreseen which switch the camera position and/or activate a corresponding camera, if a game equipment is withdrawn from the game equipment storeroom on the alley or is approximated to the alley.

BRIEF DESCRIPTION OF THE DRAWINGS

The invention is subsequently further explained on the basis of a preferred embodiment and drawings relating thereto. The drawings show.

DETAILED DESCRIPTION

Figure 1:
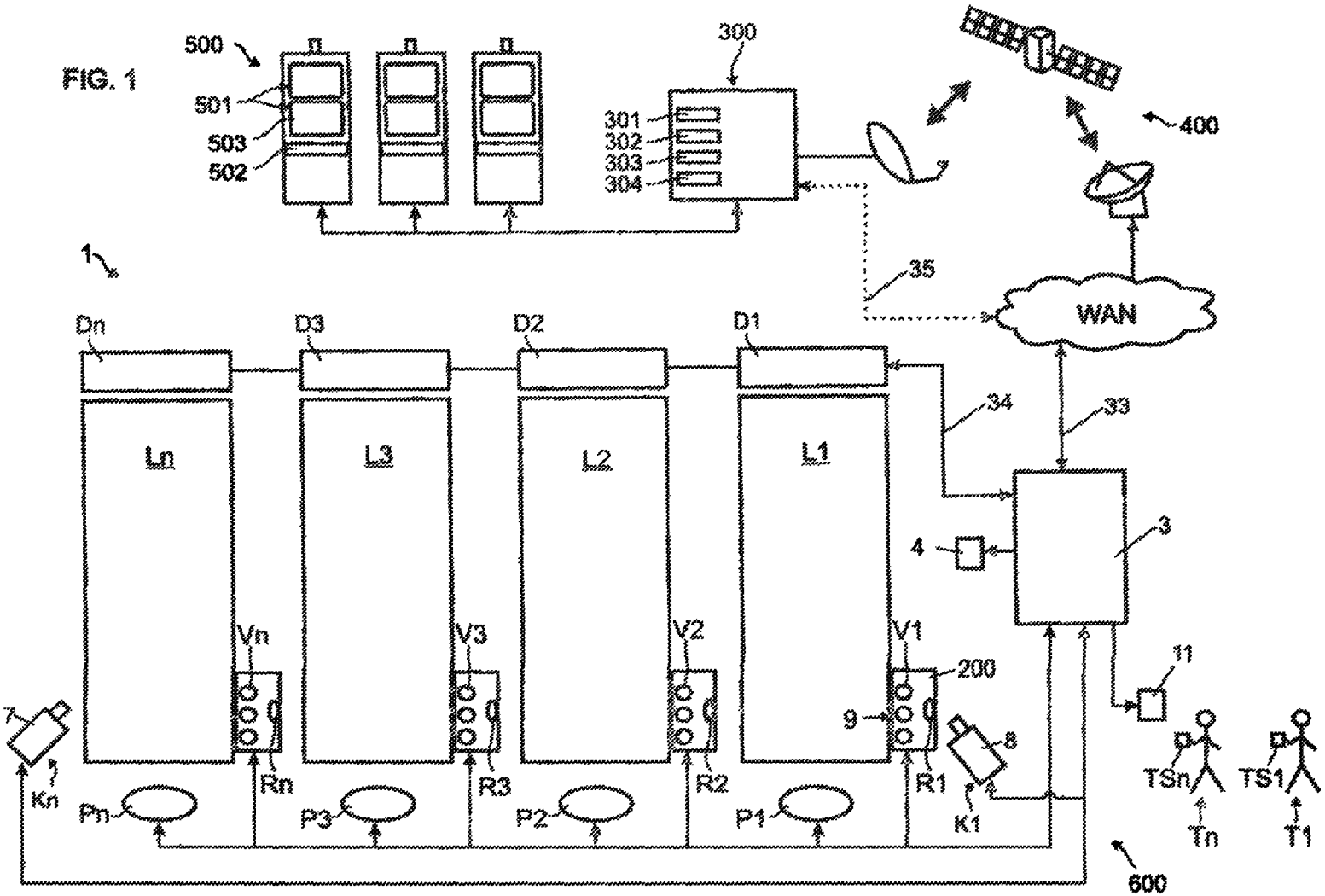
FIG. 1: a schematic representation of a multi-alley skill/skilled sport installation in form of a skittle alley, which is monitored by multiple cameras and is connected to a gambling and gaming server to which multiple gambling and/or gaming terminals are connected.

The skill/skilled sport installation shown in FIG. 1 comprises multiple alleys L1, L2, L3, Ln and advantageously can be designed as a skittle alley installation on which game equipment V1, V2, V3, Vn in the form of bowling balls or throw balls are thrown or rolled to skittles or pins positioned at the end of the alley.

As shown in FIG. 1 two cameras 7 and 8 are allocated to the skill/skilled sport installation 1 in the drawn embodiment, which monitor different sections of the skill/skilled sport installation 1 in order to be able to transmit a respective game in the form of television images.

Advantageously for the skill/skilled sport installation 1 more participants can be registered with the aid of a central computer 3 than the skill/skilled sport installation 1 has alleys. If, for example, a skittle alley installation is foreseen with four alleys eight different participants can for example be registered, wherein for each alley one participant can be registered so that a subset of the registered participants in a game can compete. If applicable, also teams of multiple participants can play on one respective alley. Per game event in each case only a maximum determined number of registered participants can be authorized for gaming on a respective alley, while the participants not selected for a game event can have a break or can have the possibility to control the system or can be allocated to other tasks such as the alley service and/or the setting of the skittles.

Figure 2:
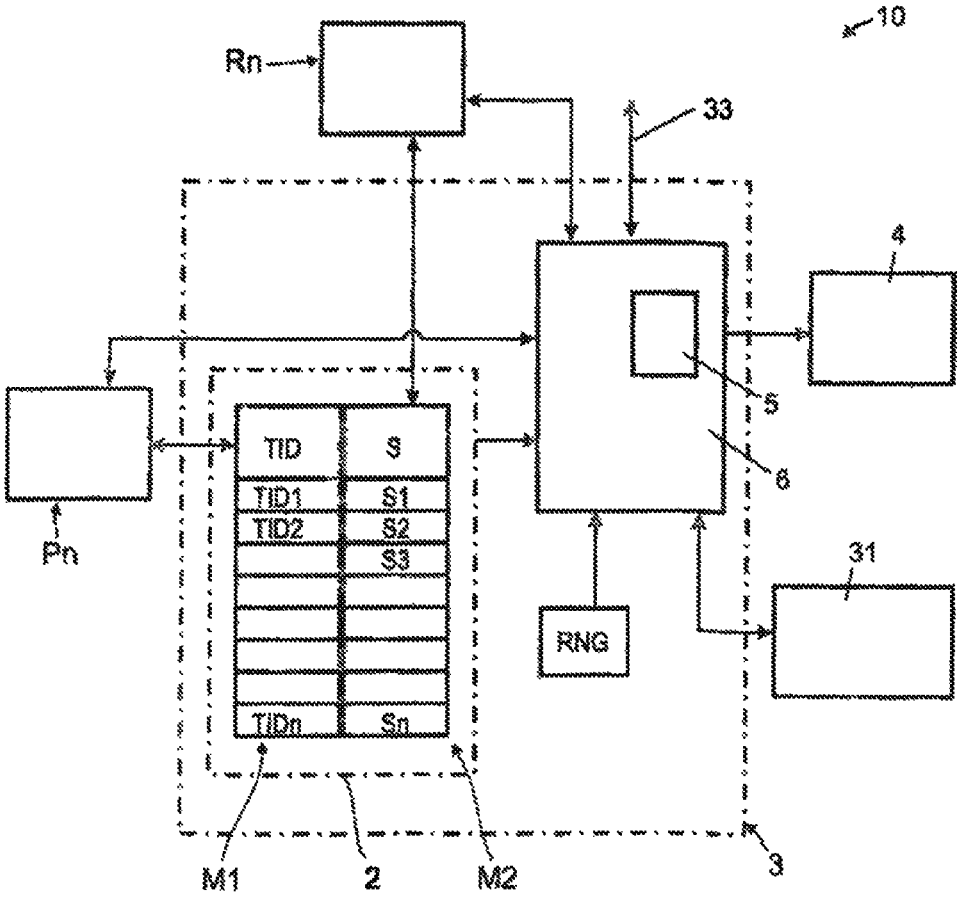
FIG. 2: a schematic representation of the control or monitoring apparatus for the game operation on the skittle alley of FIG. 1, which Shows the interplay of the central computer system with participant memory and game equipment memory as well the game control.

For a start each participant T1, Tn is allocated to a participant memory TS1, TSn preferably in form of a RFID card with a respective participant identification TID1, TIDn, wherein prior to the game operation a registration of the respective participants occurs by a suitable reception and/or reading apparatus reading out, for example, in form of a RFID reader, the respective participant memory TS1, TSn, wherein the respective associated participant identification TID is ascertained and is saved in a first memory area M1 of a central database 2, compare FIG. 2. The registration can be performed with the aid of a suitable interface 31 for the user guidance, preferably with an interface 31 with graphic user surface.

Furthermore the game equipment V1, V2, V3, Vn is equipped with a respective game equipment memory preferably in the form of a RFID element, which is allocated to a respective game equipment identification S1, S2, S3, Sn. In a subsequent step also prior to the game operation a registration of the game equipment identification occurs by readout of the game equipment memory by means of a suitable reception or reading apparatus, wherein the game equipment identification S1, S2, S3, Sn is ascertained and is transmitted to the mentioned database 2, where it is filed in a second memory area M2, compare FIGS. 1 and 2.

Preferentially multiple sets of game equipments can hereby be registered, wherein per game only one set of the game equipment is used while the other ball set can be used as replacement for substitution after a determined number of games or a determined time.

After effected registration of the game equipment V1, V2, V3, Vn and the participants T1, Tn the central computer 3 automatically performs the allocation of the participants to the game equipment prior to the game commencement and indicates this allocation on an indicator 4. As shown in FIG. 2 the computer 3 can hereby feature a random number generator RNG, which performs the allocation of the participant to the game equipment in a random manner.

Advantageously the computer 3 also performs art allocation of the game equipment to the respective alleys automatically, wherein advantageously also this allocation to the alleys is performed by the random number generator RNG in a random manner. This allocation also is indicated prior to the game commencement on the indicator 4.

Corresponding to the allocation and selection specified on the indicator 4 subsequently the game equipment V1, V2, V3, Vn is to be registered on the corresponding alleys L1, L2, L3, Ln of the skill/skilled sport installation 1. This is monitored, for example, by means of the respective game equipment memories foreseen on the balls, wherein advantageously reception/reading apparatus R1, R2, R3, Rn are allocated to the respective alleys L1, L2, Ln, for example attached to one of the ball reservoirs 200 allocated to the respective alley, in order to readout the game equipment memory of the balls. The mentioned reception/reading apparatus R1, R2, R3, Rn monitor the game equipment identification S1, S2, S3, Sn and impart these to a release apparatus 5 which is arranged in the computer 3. If the right participant is standing with the right ball in the right alley the corresponding alley and the corresponding ball is released in the ball memory 200.

Hereto also the participant memory TS1, TS2, TSn of the respective participants is readout by means of the there foreseen reception/reading apparatus P1, P2, Pn. This can occur, for example, by the respective participant entering his RFID card into the corresponding reading apparatus P1, P2, P3, Pn or bringing it into contactless communication. The readout participant identification TID1, TID2, TIDn is subsequently sent to the mentioned release apparatus 5 in order to be compared there with the allocation specified by the computer 3 in accordance with the indicator 4 according to FIG. 2. If the right participant is on the right alley, the respective alley or the skittle setter apparatus D1, D2, D3, Dn allocated thereto is released. The respective skittle setter apparatus D1, D2, D3, Dn can be connected to the computer 3 via a wired and/or wireless data connection 34.

If all participants are on the specified alleys, and if all game equipment V1, V2, V3, Vn is on the right alleys the computer 3 can generate a corresponding starting signal, which is made to indicate in a suitable manner, for example also on the indicator 4.

Depending on which participant becomes active and plays an alley the corresponding camera 7 or 8 is activated in order to transmit the attempt. Advantageously the switch of the mentioned cameras 7, 8 can be controlled in dependence of the readout game equipment identification. If for example switch means 9,10 are foreseen on the ball memory 200 of the skill/skilled sport installation 1, which register the removal of a respective game equipment V1, V2, Vn, the corresponding cameras 7, 8 can be put in operation or the provided image thereof can be released for transmission, wherein, for example, the camera angle of the computer 3 can be placed onto the alley, on which a ball was taken from the ball memory 200.

Advantageously prior to each game and/or after the execution of a specified number of games a renewed ascertainment of a combination participant<->game equipment<->alley can take place, wherein it is also possible to select out of all registered participants. Advantageously the computer 3 performs this automatically. With the mentioned renewed ascertainment of the participants, the game equipment and the alleys and their allocation to each other the security against manipulation or collusion is increased.

Figure 3:
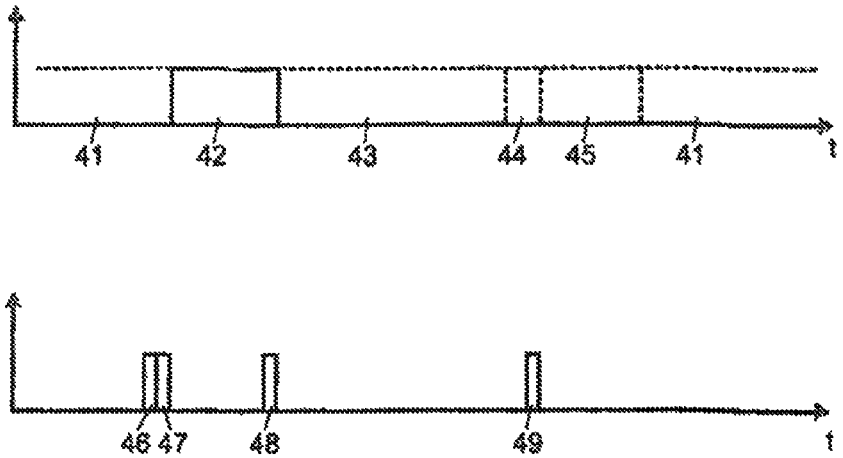
FIG. 3: a time lapse diagram with two time axis, which shows the interplay of the control of the gambling operation, which controls the gambling of a game.

As shown in FIG. 3 in the partial view (a) and (b) the control and monitoring system of the game operation can also be used to select a transmission and/or gambling control apparatus 300, which controls the placement of bets on a game event and indicates the achieved winnings. As shown in the comparison of the two timelines in FIG. 3 initially, as shown in FIG. 3 (*a*), in a waiting phase 41 prior to the game with the aid of the computer 3 at a game setup event 46 the mentioned selection and allocation of the participants, the game equipment and the alleys is performed and indicated as "Game Setup" on the indicator 4, wherein after a quote calculation event 47 also a determination and indication of the gambling odds can be performed. Subsequently a gambling time slot 42 for the acceptance of bets on, for example, a gambling terminal is opened by the mentioned gambling operation control apparatus, which shortly or immediately before the commencement of the corresponding game is shut again. If the mentioned gambling time slot is shut automatically by the apparatus the starting signal 48 for the game is given and by means of the cameras 7 and 8 the game event is transmitted during a live event time slot 43, for example, via satellite connection 400 and indicated on the gambling terminal. After the end of the game, for example, the game outcome, i.e. in particular the finish can be retransmitted during a finish time slot 44 in slow motion. The mentioned gambling operation control apparatus announces the outcome following a confirmation event 49, and displays the winning as win animation 45.

The gambling of a game event during the mentioned gambling time slot 42 can hereby in principle be organized differently. The gaming or gambling terminal 500, which is in connection to be described with the game installation, has advantageously an indication apparatus 501, for example in form of one or multiple displays, and an input apparatus 502, for example in form of a keyboard or a touch screen, in order to be able to enter a piece of stake and other gambling or gaming orders in the apparatus, as well as an outcome ascertainment apparatus 302 for the ascertainment of winning numbers or winning number combinations, wherein the mentioned outcome ascertainment apparatus 302 is foreseen immediately in the gambling terminal 500 but also advantageously in a therewith connected, separate gambling and/or gaming server 300, which advantageously can select multiple gambling terminals 500 mid connect with the skill/skilled sport installation 1. As shown in FIG. 1 the central computer 3, which controls the monitoring of the skittle alleys and the game operation on the skittle alleys, can communicate via a data connection 33 and a data network WAN and a data distance connection, for example, in form of a satellite communication connection 400 with the central gambling and/or gaming server 300. The gambling and/or gaming server 300 can alternatively or additionally be connected via a wired data connection 35 with the data network WAN. The mentioned gambling and/or gaming server 300 can be arranged in a casino, but also hereof separately and communicate via suitable data connection means with the gambling terminal 500 or a casino server on site.

In order to make the placement of a piece of stake in a simple form possible the gambling terminal 500 has advantageously a betting field 503, which can be displayed for example in form of virtual representation on a screen. As shown in FIG. 4 the mentioned betting field 503 can be designed in the form of a roulette game betting field, which comprises a number matrix or a multitude of numbers, which are distributed in a specified allocation across the betting field 503. In order to place gambling or gaming stakes it can be foreseen, for example, that individual numbers of the betting fields 503 are tipped on or specific sections of the betting field and thereby a determined group of winning numbers are marked.

The ascertainment of the winning number occurs subsequently in the mentioned manner with a game on a skittle alley installation 1, wherein it can be foreseen, for example, that the winning number of multiple game outcomes is/are calculated, for example in such a manner that each one attempt on each of the four alleys is considered and subsequently the number of hits of each attempt performed per alley is added. In the shown example shown in FIG. 4 the winning number 16 was ascertained as on the first alley seven skittles, on the second alley two skittles, on the third alley four skittles and on the fourth alley three skittles, i.e. altogether sixteen skittles, were overturned.

Figure 4A:
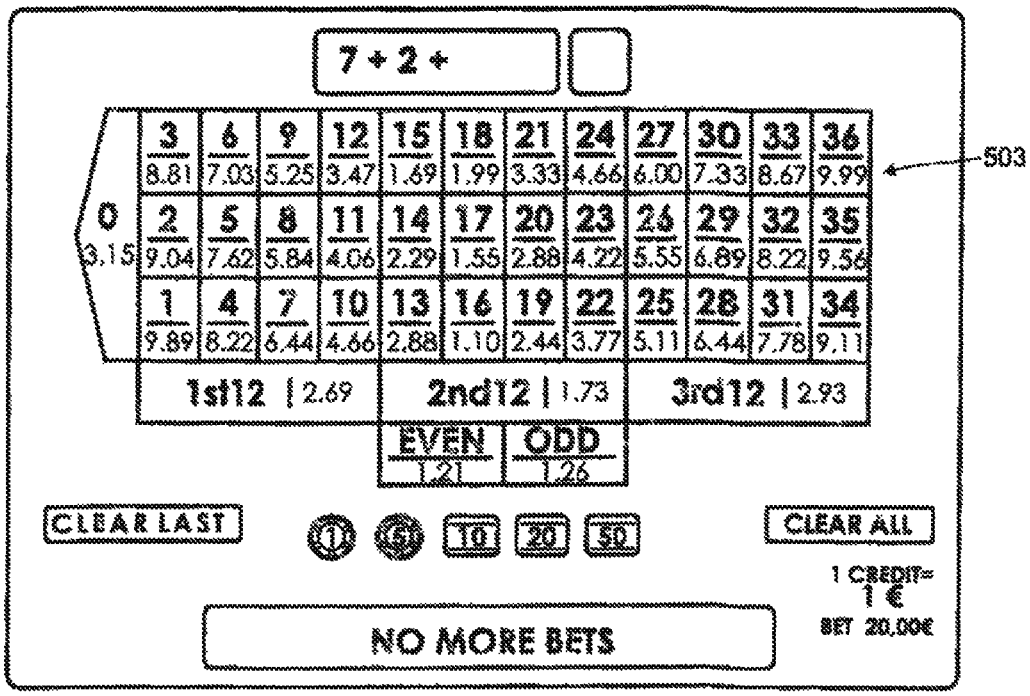
FIG. 4A, 4B: a partial representation of a gambling terminal from the gambling system of FIG. 1, which shows the betting field displayable on the screen of the gambling terminal according to a preferable embodiment of the invention, according to which the mentioned betting field is designed in the manner of a roulette betting field, wherein the partial views 4A and 4B Show the betting field in different game phases.
Figure 4B:
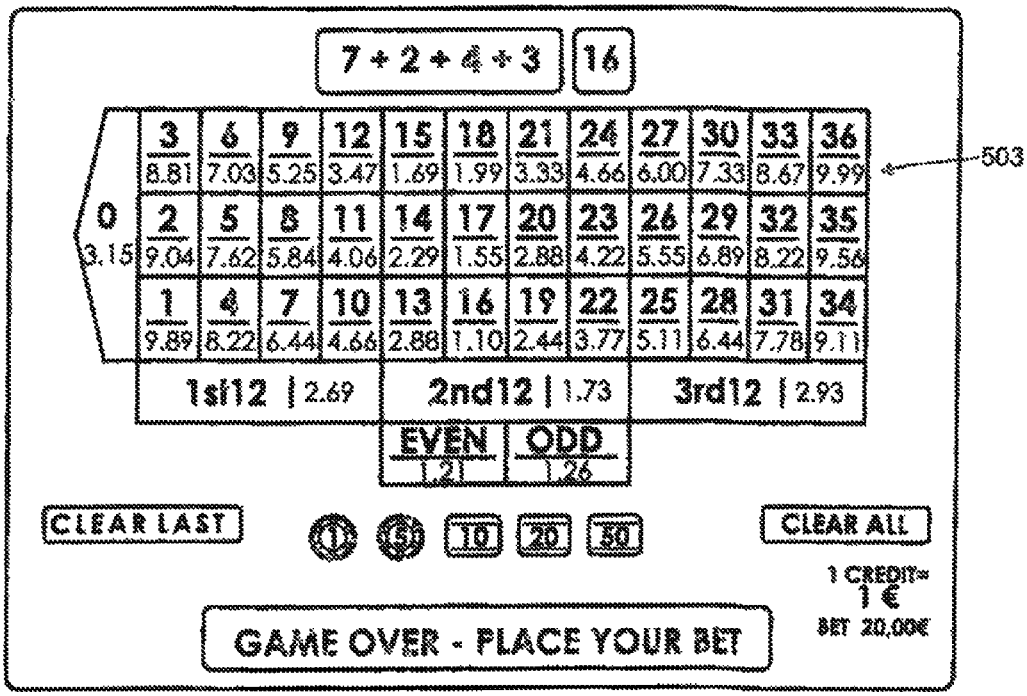

As a comparison of the partial views FIG. 4A and FIG. 4B shows, the procedure of playing a winning number cannot only be followed over the screen 501, on which, for example, images created by the cameras 7 and 8 can be indicated, but also immediately at the betting field 503. In particular the respective game outcomes achieved on the alleys can be indicated in form of respectively overturned skittles so that the ascertainment of the respective winning number can be easily followed. The partial view in FIG. 4A shows in the upper indicator panel the number "7" and "2" of skittles already overturned. If the game continues then also the other alley outcomes, as shown in FIG. 4B, i.e. four overturned skittles and three overturned skittles, are indicated and subsequently the winning number "16" resulting thereof is displayed.

Figure 5:
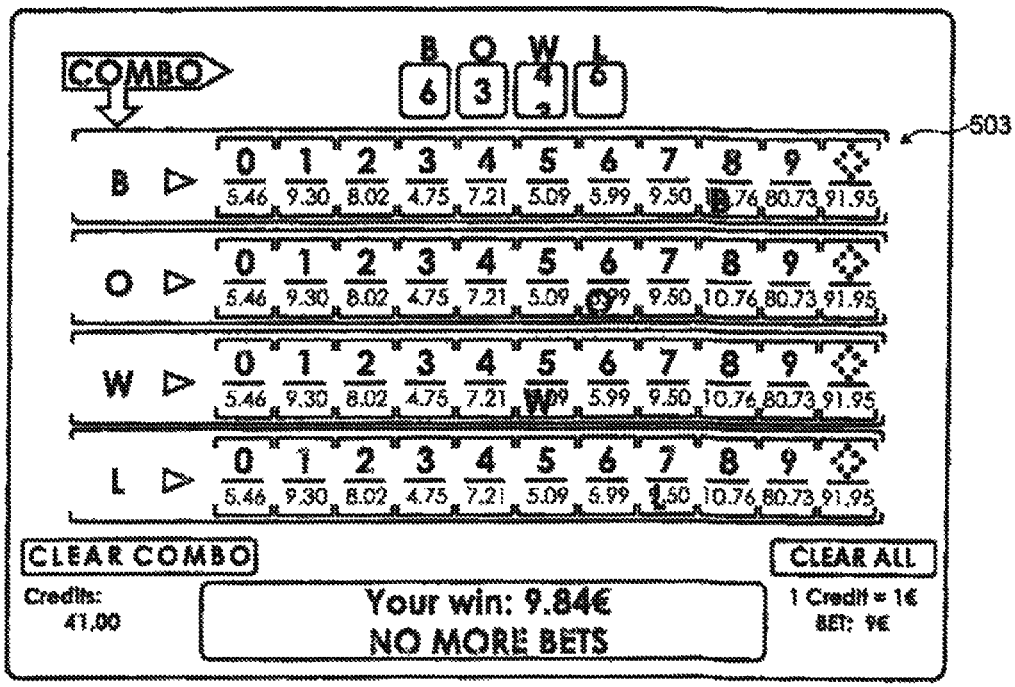
FIG. 5: a partial representation of a gambling terminals of the gambling system of FIG. 1, which shows the betting field displayable on a screen of the gambling terminal according, to a further preferable embodiment of the invention, wherein the mentioned betting field is designed in the manner of a bingo game betting field, where in different rows different numbers are can be gambled.
Figure 6:
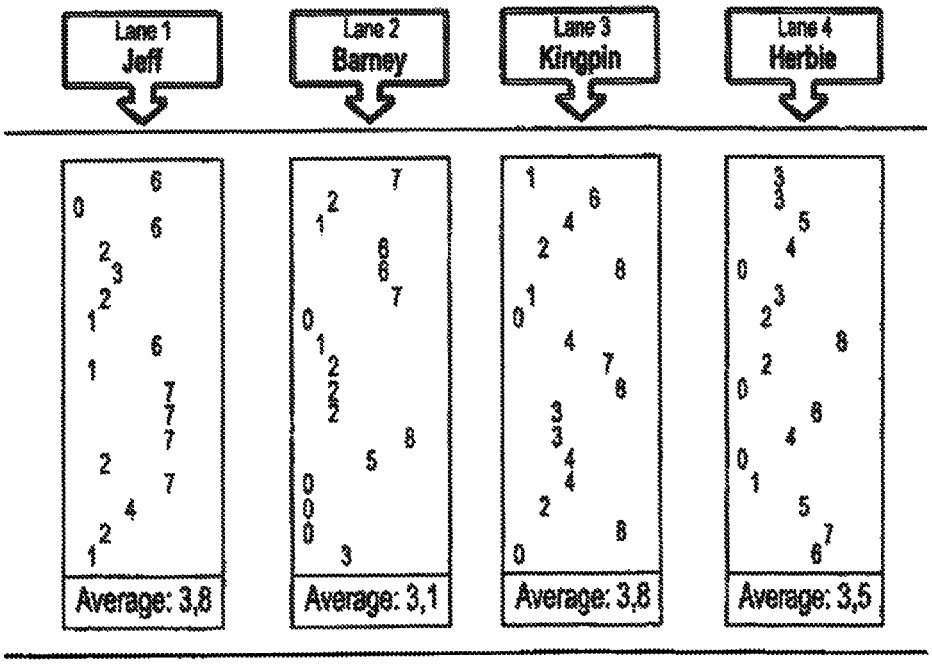
FIG. 6: an indication of historical data relating to events per alley as well as a statistical evaluation of the data.

Furthermore advantageously on the betting field 503 also the gambling odds allocated to the individual winning numbers can be indicated, which, for example, can be determined by an electronic gambling odds determination apparatus 303, which, for example, can be allocated to the central gambling and/or gaming server 300, but can also be designed as a separate component. As the FIGS. 4A and 4B show, the respective gambling odds can be immediately allocated to possible winning numbers. For example FIG. 4A shows for the winning number "3" gambling odds of 8.81 while for the winning number "0" gambling odds of 3.15 are indicated. The winning number 16 played in the example is reserved for the gambling odds of 1.10 so that with a stake of one euro one euro and ten cent are paid out as winnings. The electronic gambling odds determination apparatus 303 can determine the gambling odds by means of statistical prediction models and take hereby into consideration also dynamic actuating variables such as the frequency of the numbers bet on, amount of the pieces of stake placed on a number, etc. The gambling odds prior to the commencement of a game are specified and are indicated on the screen, so that a player prior to the gambling knows which odds he will get As shown in FIG. 5 the mentioned betting field 503 can also be structured in the manner of a bingo game, wherein in the different number rows different number slots can be marked. In each number sequence are hereby the possible game outcomes, i.e. discrete numerical values of the skill/skilled sport, contained so that each number of each number sequence can be played. Advantageously the number of overturned skittles on different alleys can hereby be allocated to each number sequence, i.e. the game outcome on the first alley can be allocated to the first number sequence, the game outcome of the second alley can be allocated to the second number sequence, etc. If, for example, on the first alley seven skittles are overturned the winning number in the first number line would be 7, if on the second alley no skittle is overturned the winning number would be 0 in the second number line, etc. In accordance with the betting field of FIG. 5 an additional input possibility in the present case for an additional winnings "Combo" can be undertaken, wherein this is here performed by a placing of the respective symbols "B", "O", "W", and "L," in the respecting betting lines.

Figure 7:
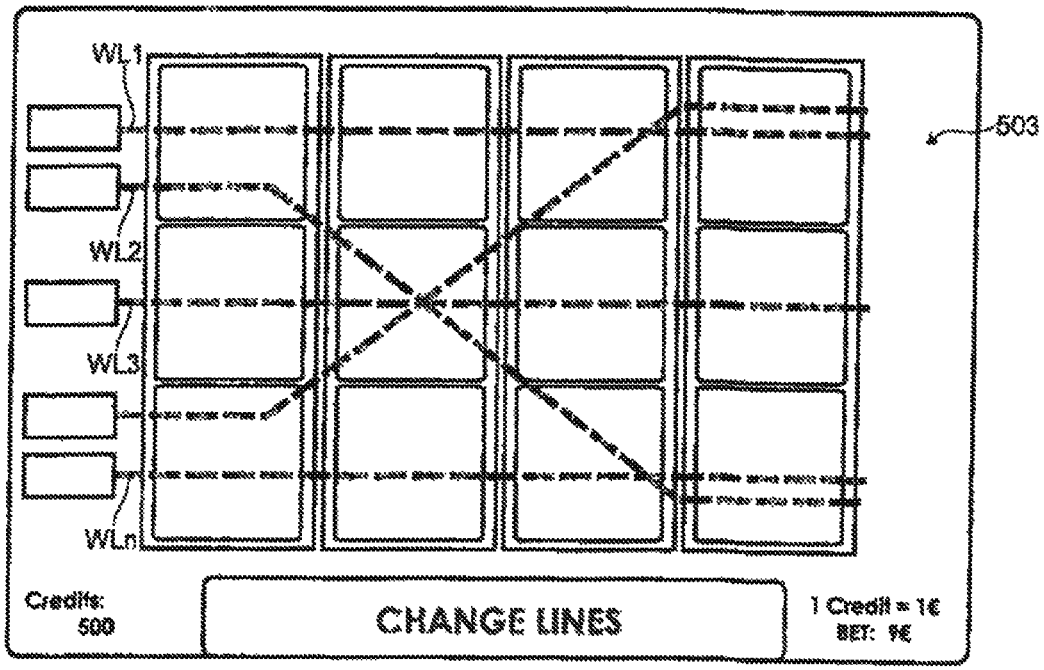
FIG. 7, 8: a partial representation of a gambling terminal of the gambling system of FIG. 1, which shows the betting field displayable on a screen of the gambling terminal according to a further embodiment of the invention, wherein the mentioned betting field has in the manner of a reel game multiple paylines along which the numbers to be predicted have to occur in order to achieve winnings.
Figure 8:
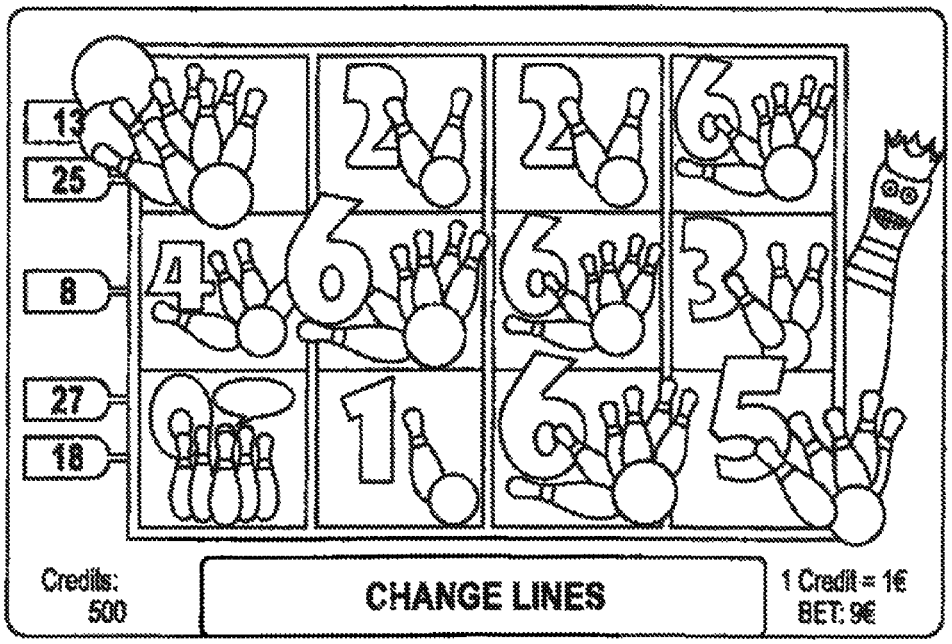

A further embodiment is shown in FIGS. 7 and 8. Here the betting field 503 is built in the manner of a reel game and can comprise a number matrix or a winning field matrix with multiple number slots, which can, for example, be shown as a pop-up, wherein for the respective number slots of the betting field 503 a determined winning number must be predicted. Hereby with the placing of the winning lines WL1, WL2, WL3, WLn, determined groups in the betting field can be marked along which the determined number combinations are then to be predicted and/or along which then determined number combinations must occur in order to achieve a win. For example, in the present case a reel game apparatus is formed by four (4) reels, wherein each reel features a number of symbols and wherein here in the indication three respective symbols are indicated visibly—therefore a 3×4 matrix with 3 lines and 4 columns is given. Furthermore determined win lines WL1, WL2, WL3, WLn are defined across determined fields of this matrix, compare dotted lines as shown in FIG. 7.

For example a diagonal win line WL2 can be selected, which marks in the first line the first number slot, in the second line the second number slot, and in the third line the third and fourth number slot. Subsequently via the input apparatus on the gambling terminal the desired winning numbers occurring along the mentioned win line WL2 can be placed. Alternatively or additionally also the sum values occurring in a line, as shown in FIG. 7, can be shown. In the example shown in FIG. 8 the sum values 13 and 25 of the first line are for example "gambled on". On the skittle alley installation 1 in the corresponding round on the first skittle alley subsequently eight skittles, on the second skittle alley six skittles, on the third skittle alley six skittles and on the fourth alley five skittles were overturned so that for the mentioned win row or line the winning number 8, 6, 6, and 5 were ascertained, which corresponds to a win sum of 8+6+6+5=25 so that the placed number 25 wins.

With the operation as a reel game apparatus all reels can put into a reel run through the activation of a game starting signal. With mechanical reels it can be a matter of pivoting, of a reel body around the reel axis of rotation, with a video reel design this pivoting can be represented as a simulation through an animation of the indication apparatus.

Subsequently the number ascertained per alley can be used which brings the reel allocated to the respective alley to a standstill. The evaluation of the winning outcome can occur in a usual manner by means of the concurring numbers or symbols along a win line.

Figure 9:
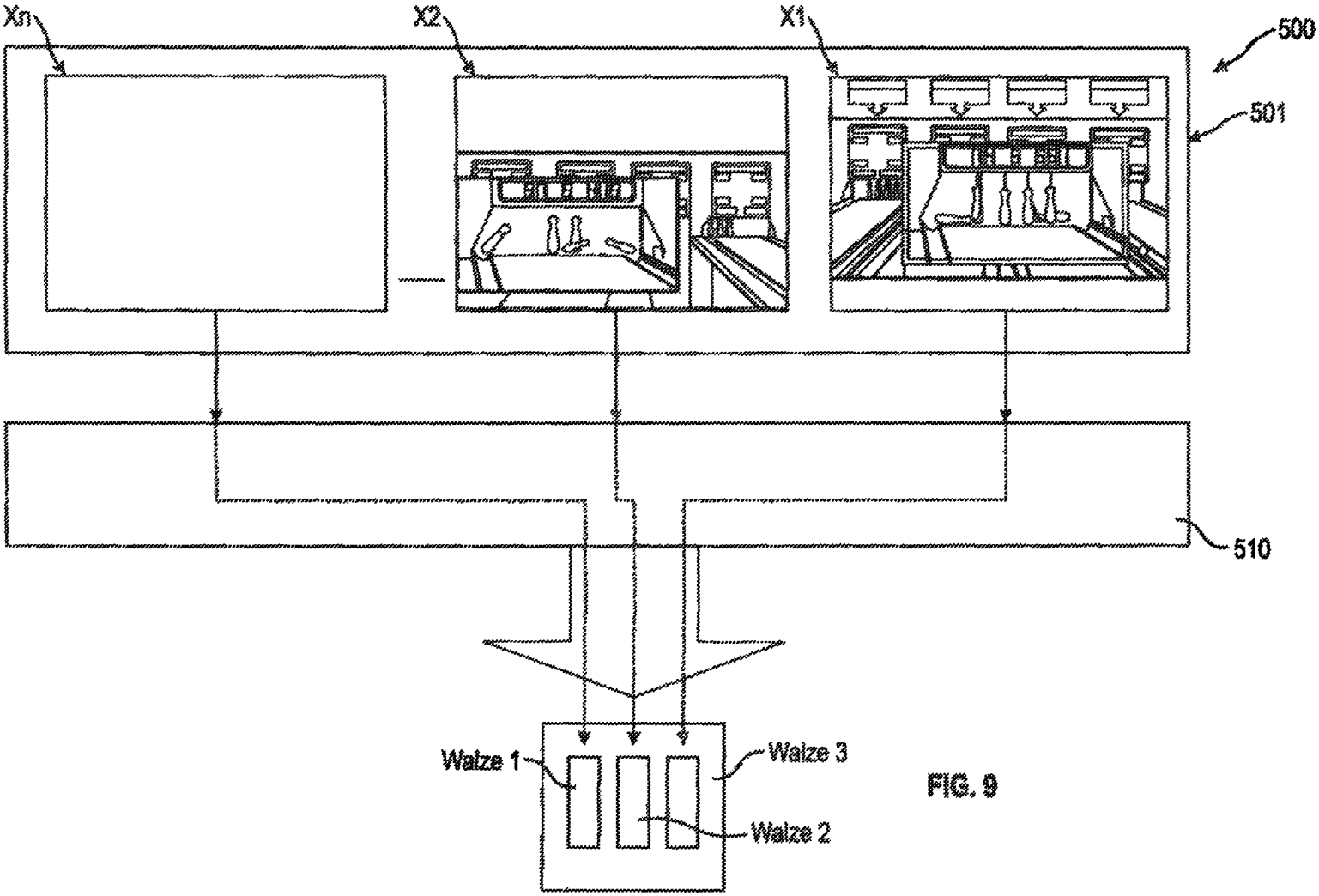
FIG. 9: a schematic representation of a selection apparatus foreseeable on a gambling terminal for the selection of at least one or multiple skittle alleys for the ascertainment of a winning number by means of the game outcomes of at least one of the selected skittle alleys according to a further advantageous embodiment of the invention, wherein for different reels of a reel game different skittle alleys for the winning number ascertainment are selectable.

In a further advantageous embodiment of the invention it can also be foreseen that for the ascertainment of different winning numbers or the ascertainment of the assignment of the number slots of a winning number combination different skill/skilled sport installations 2 can be used. For example, on the screen 501 of a gambling terminal 500 different skittle alleys at different locations can be indicated, for example the first skittle alley in Vienna, the second skittle alley in Munich, and a third skittle alley in Milan, wherein the there occurring course of the game can be indicated, for example, by corresponding cameras. At the gambling terminal 500 a selection apparatus 510 can be advantageously foreseen in form of a touch screen in order to facilitate the user the selection of a desired skittle alley for the ascertainment of "his" winning numbers. In the embodiment shown in FIG. 9 hereby different skittle alleys or skill/skilled, sport installations X1, X2, Xn can be selected in order to ascertain the winning numbers occurring on a reel game apparatus wherein in the drawn embodiment three reels are foreseen whose winning number assignment or stoppage is controlled respectively by a different game. The reels can be designed as mechanical reels or as video reels, for example in the form of symbols, which are displayed in a matrix arrangement on an electronic monitor. Alternatively to the configuration the selection apparatus 510 can be foreseen on a casino server. Furthermore the selection apparatus 510 can be designed as a web interface which is operable and/or configurable via a web browser and can impart correspondingly configured and/or selected data of the different skittle alleys or skill/skilled sport installations X1, X2, Xn as a random numbers or random numbers.

We claim:

1. A gambling system comprising:

an input apparatus for inputting a piece of a stake and/or playing-tip information in a form of a number and/or a number combination and/or a number matrix, wherein the input apparatus includes at least one of a keyboard and a touchscreen;

an outcome ascertainment apparatus for ascertaining a winning number and/or a winning number combination and/or a winning number matrix;

an indicator apparatus for indicating the ascertained winning number and/or the ascertained winning number combination and/or winning number matrix; and a win ascertainment apparatus for ascertaining a gambling or gaming win from a comparison of the ascertained winning number and/or the ascertained winning number combination and/or the ascertained winning number matrix with the input stake and/or playing-tip information;

wherein the outcome ascertainment apparatus comprises:

multiple monitoring apparatus for monitoring multiple skill and/or skilled sport installations at different and/or separate geographic locations, wherein the multiple skill and/or skilled sport installations provide multiple game outcomes as a result of games played by participants and wherein the multiple monitoring apparatus comprise multiple game outcome determination devices for determining the multiple game outcomes; and a determination device for determining a winning number matrix and/or winning number and/or winning number combination from the multiple game outcomes of the multiple skill and/or skilled sport installations at different and/or separate geographic locations.

2. The system of claim 1, wherein the multiple skill and/or skilled sport installations include skittle alleys, bowling alleys, dart stands, and/or shooting gallery installations.

3. The system of claim 1, wherein the input apparatus comprises at least one screen for displaying a betting field, wherein the betting field includes a display of numbers and/or number combinations and/or number matrices that the user is permitted to select as part of the input stake and/or playing-tip information inputted by the user.

4. The system of claim 3, wherein the at least one screen is configured to display a betting field indicator, wherein the betting field indicator is controlled by the outcome ascertainment apparatus and is dependent on the multiple game outcomes of the multiple skill and/or skilled sport installations and wherein the betting field indicator displays the winning number and/or winning number combination and/or winning number matrix ascertained by the outcome ascertainment apparatus.

5. The system of claim 1, wherein the determination device comprises a computation apparatus for the computation of the winning number out of the multiple game outcomes forming numerical values in accordance with a specifiable calculation specification and/or an allocation apparatus for the allocation of individual numerical values or the numbers calculated by the computation apparatus to each number slot of the winning number combination and/or the winning number matrix in accordance with a specifiable allocation specification.

6. The system of claim 1, further comprising a selection apparatus for selecting from the multiple monitoring apparatus monitoring the multiple skill and/or skilled sport installations, and wherein the determination device determines the winning number and/or winning number combination and/or winning number matrix from the multiple game outcomes of the multiple skill and/or skilled sport installations at different and/or separate geographic locations monitored by the multiple monitoring apparatus.

7. The system of claim 6, further comprising a computer having a random number generator (RNG) for randomly selecting one or more skill and/or skilled sport installations from the multiple skill and/or skilled sport installations at different and/or separate geographic locations for the determination of the winning number and/or winning number combination and/or winning number matrix.

8. The system of claim 6, wherein the input apparatus is configured to receive a user input from a user of the gambling and/or gaming apparatus in order to select one or more skill and/or skilled sport installations from the multiple skill and/or skilled sport installations at different and/or separate geographic locations for the determination of the winning number and/or winning number combination and/or winning number matrix.

9. The system of claim 1, wherein the determination device determines the winning number matrix and/or the winning number combination by selecting one winning number of the winning number matrix and/or the winning number combination from one game outcome from one skill and/or skilled sport installation at one geographic location and another winning number of the winning number matrix and/or the winning number combination from another game outcome from another skill and/or skilled sport installation at another geographic location.

10. The system of claim 1, wherein the multiple skill and/or skilled sport installations are equipped with usable game equipment, wherein the usable game equipment comprises game equipment memory in which game equipment data is saved and wherein the multiple skill and/or skilled sport installations are also equipped with reception and/or reading apparatus configured to read out the game equipment data from the game equipment memory and save the game equipment data in a database.

11. The system of claim 10, further comprising a participant memory for each game participant separate from the game equipment memory for storing and/or saving participant data, wherein the participant data is readout by the reception and/or reading apparatus at the multiple skill and/or skilled sport installations or by another reception and/or reading apparatus and wherein the participant data is saved in the database or in another database, and wherein the usable game equipment is allocated to the participant by an allocator computer and such allocation is saved in the database or in another database.

12. The system of claim 10, wherein the game equipment memory and/or the participant memory comprise RFID elements and the reception and/or reading apparatus comprise RFID reading apparatus.

13. The system of claim 1, further comprising a computer having a random number generator (RNG), wherein the RNG is configured to randomly allocate the usable game equipment to the game participants and such allocation is saved as part of the game equipment data and the participant data, and further comprising an indicator apparatus for indicating the allocation of the usable game equipment to the game participants prior to the commencement of the skill and/or skilled sport games.

14. The system of claim 10, wherein each of the multiple skill and/or skilled sport installations is equipped with a reception and/or reading apparatus for reading out the game equipment data from the game equipment memory, and wherein the reception and/or reading apparatus is configured to read out the game equipment data of the usable game equipment that is physically located at the same skill and/or skilled sport installation in which the reception and/or reading apparatus is installed.

15. The system of claim 1, further comprising a random number generator (RNG), wherein the RNG is configured to randomly allocate the usable game equipment to a particular skittle alley, bowling alley, dart stand, and/or shooting gallery installation at the skill and/or skilled sport installation and such allocation is saved as part of the game equipment data, and further comprising an indicator apparatus for indicating the allocation of the usable game equipment to the particular skittle alley, bowling alley, dart stand, and/or shooting gallery installation prior to the commencement of the skill and/or skilled sport game.

16. The system of claim 15. further comprising a release apparatus, wherein the release apparatus only releases the particular skittle alley, bowling alley, dart stand, and/or shooting gallery installation if the game equipment data read out by the reception and/or reading apparatus located at the particular skittle alley, bowling alley, dart stand, and/or shooting gallery installation corresponds with the allocation of the game equipment.

17. The system of claim 1, wherein the multiple monitoring apparatus comprises at least one camera for monitoring the skill and/or skilled sport installation, wherein the location within the skill and/or skilled sport installation monitored by the camera is dependent on and/or controlled by the game equipment data read out from the game equipment memory and/or is dependent on and/or controlled by the participant data read out from the participant memory.

18. The system of claim 17, wherein the multiple skill and/or skilled sport installations are monitored by multiple cameras, whereby switch times between the multiple cameras are dependent on and/or controlled by the game equipment data readout from the game equipment memory.

19. The system of claim 11, further comprising a starting apparatus for generating a game commencement signal to indicate commencement of the skill and/or skilled sport game, wherein the game commencement signal is generated when the usable game equipment used by the participant matches the allocation predetermined by the allocator computer and/or the usable game equipment and/or the participant is at the skittle alley, bowling alley, dart stand, and/or shooting gallery installation predetermined by the allocator computer.

20. The system of claim 1, furthering comprising at least one screen for displaying an image recording recorded by a camera of at least one of the multiple monitoring apparatus monitoring the multiple skill and/or skilled sport installations, wherein the at least one screen is preferably arranged at a position visible from the input apparatus.

21. The system of claim 1, further comprising a time control apparatus for the specification of a gambling time slot, wherein the time control apparatus is controllable by a computer controlling the multiple skill and/or skilled sport installations and/or is dependent on the monitoring of participant data and/or game equipment data and/or the allocation of participant data and/or game equipment data to the alleys on the skill and/or skilled sport installation.

22. The system of claim 1, further comprising an electronic gambling odds ascertainment apparatus for the automatic ascertainment of gambling odds allocated to the winnings and/or winning number combination and/or winning number matrix and the win ascertainment apparatus utilizes the gambling odds automatically ascertained by the electronic gambling odds ascertainment apparatus to ascertain a gambling or gaining win.

* * * * *